US008674671B2

(12) United States Patent
Hikichi et al.

(10) Patent No.: US 8,674,671 B2
(45) Date of Patent: Mar. 18, 2014

(54) CONSTANT-VOLTAGE POWER SUPPLY CIRCUIT

(75) Inventors: Yusuke Hikichi, Kawasaki (JP); Yutaka Tamura, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 94 days.

(21) Appl. No.: 13/423,567

(22) Filed: Mar. 19, 2012

(65) Prior Publication Data

US 2013/0063115 A1 Mar. 14, 2013

(30) Foreign Application Priority Data

Sep. 8, 2011 (JP) ..... 2011-196213

(51) Int. Cl.
*G05F 1/00* (2006.01)

(52) U.S. Cl.
USPC ..... 323/274; 323/303; 323/315

(58) Field of Classification Search
USPC ..... 323/226, 273, 274, 275, 276, 279, 299, 323/303, 315; 361/93.9
See application file for complete search history.

(56) References Cited

U.S. PATENT DOCUMENTS

| | | | | |
|---|---|---|---|---|
| 7,030,686 | B2 * | 4/2006 | Itoh | 327/541 |
| 7,411,376 | B2 * | 8/2008 | Zhang | 323/277 |
| 7,548,044 | B2 * | 6/2009 | Itoh et al. | 323/274 |
| 7,772,815 | B2 * | 8/2010 | Okuda et al. | 323/280 |

FOREIGN PATENT DOCUMENTS

JP 2007-133730 A 5/2007

OTHER PUBLICATIONS

Background Art Information Sheet provided by Applicants, Dec. 13, 2011 (1 page total).

* cited by examiner

*Primary Examiner* — Gary L Laxton
*Assistant Examiner* — Kyle J Moody
(74) *Attorney, Agent, or Firm* — Posz Law Group, PLC

(57) ABSTRACT

A constant-voltage power supply circuit includes a first transistor connected between a power supply terminal and an output terminal. The constant-voltage power supply circuit includes a voltage divider circuit including a first resistor having a first end connected to the output terminal and a second resistor having a first end connected to a second end of the first resistor and a second end connected to ground. The constant-voltage power supply circuit includes an output voltage control amplifier that compares the divided voltage and a reference voltage and controls a voltage of a control terminal of the first transistor. The constant-voltage power supply circuit includes a current-limiting characteristic control circuit that controls the voltage of the control terminal of the first transistor according to the divided voltage and an output current.

20 Claims, 3 Drawing Sheets

CONSTANT-VOLTAGE POWER SUPPLY CIRCUIT

CROSS-REFERENCE TO RELATED APPLICATION

This application is based upon and claims the benefit of priority from the prior Japanese Patent Application No. 2011-196213, filed on Sep. 8, 2011, the entire contents of which are incorporated herein by reference.

FIELD

Embodiments described herein relate generally to a constant-voltage power supply circuit.

BACKGROUND

Conventionally, constant-voltage power supply circuits have been available, each including a constant current control circuit and a current-limiting characteristic control circuit. In a conventional constant-voltage power supply circuit, an output voltage for operating a current-limiting characteristic control circuit remains constant. Thus, as a target value for an output voltage increases, a larger power loss is generated by an output transistor.

DETAILED DESCRIPTION

Figure 1:
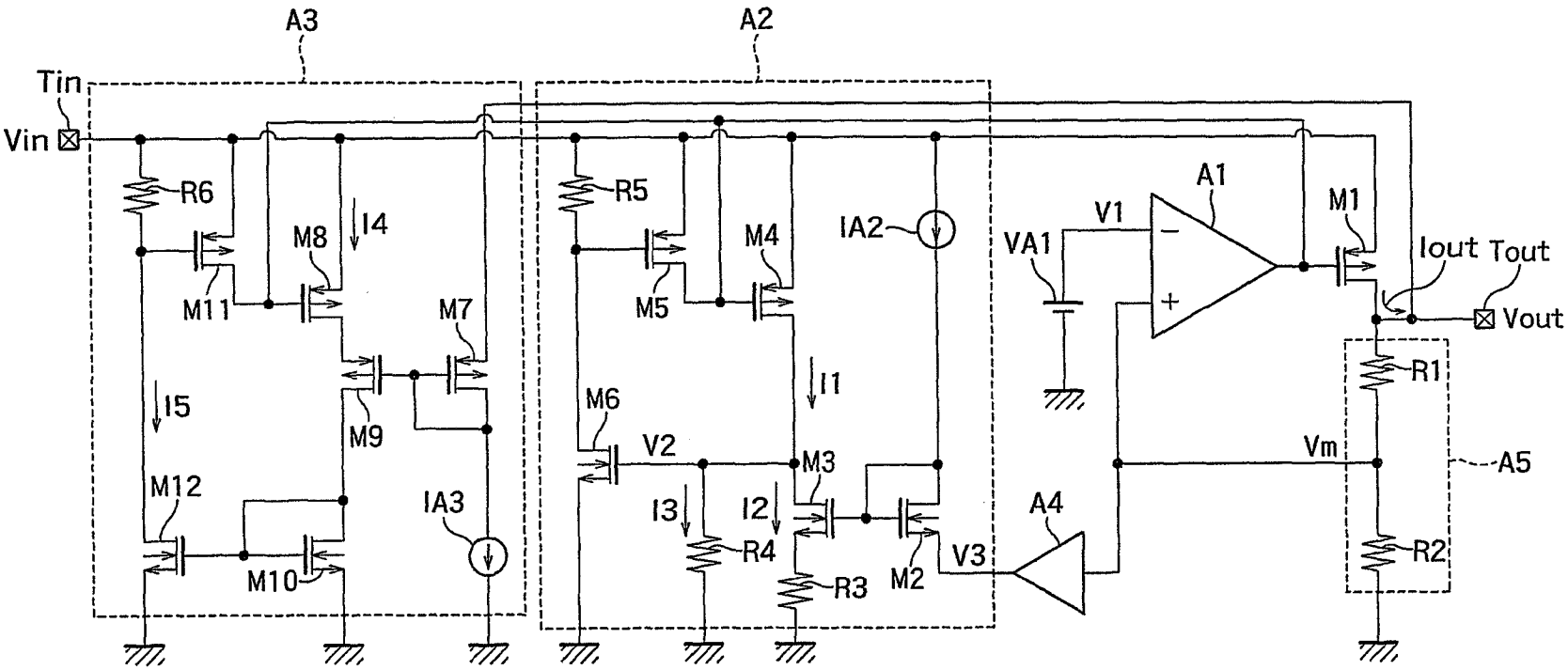
FIG. 1 is a circuit diagram illustrating an example of a circuit configuration of a constant-voltage power supply circuit 100 according to a first embodiment.

A constant-voltage power supply circuit according to an embodiment includes a first transistor of a first conductivity type, connected between a power supply terminal and an output terminal. The constant-voltage power supply circuit includes a voltage divider circuit including a first resistor having a first end connected to the output terminal and a second resistor having a first end connected to a second end of the first resistor and a second end connected to ground, the voltage divider circuit outputting a divided voltage between the first resistor and the second resistor. The constant-voltage power supply circuit includes an output voltage control amplifier comparing the divided voltage and a reference voltage and controlling a voltage of a control terminal of the first transistor so as to equalize the divided voltage and the reference voltage. The constant-voltage power supply circuit includes a current-limiting characteristic control circuit controlling the voltage of the control terminal of the first transistor according to the divided voltage and an output current.

The current-limiting characteristic control circuit includes a first constant current source having a first end connected to the power supply terminal and outputting a constant current. The current-limiting characteristic control circuit includes a second transistor of a second conductivity type, being diode-connected, having a first end connected to a second end of the first constant current source, and having a second end supplied with a control voltage based on the divided voltage. The current-limiting characteristic control circuit includes a third transistor of the second conductivity type, having a control terminal connected to a control terminal of the second transistor. The current-limiting characteristic control circuit includes a fourth transistor of the first conductivity type, being connected between the power supply terminal and a first end of the third transistor and having a control terminal connected to the control terminal of the first transistor. The current-limiting characteristic control circuit includes a third resistor connected between a second end of the third transistor and the ground. The current-limiting characteristic control circuit includes a fourth resistor connected between the first end of the third transistor and the ground. The current-limiting characteristic control circuit includes a fifth transistor of the first conductivity type, having a first end connected to the power supply terminal and a second end connected to the control terminal of the first transistor and the control terminal of the fourth transistor. The current-limiting characteristic control circuit includes a fifth resistor connected between the power supply terminal and a control terminal of the fifth transistor. The current-limiting characteristic control circuit includes a sixth transistor of the second conductivity type, being connected between the control terminal of the fifth transistor and the ground and having a control terminal connected to the first end of the third transistor.

Hereafter, a constant-voltage power supply circuit according to the present invention will be described more specifically with reference to the drawings. An embodiment will be described below with reference to the accompanying drawings. In the following embodiment, a transistor of a first conductivity type is a pMOS transistor and a transistor of a second conductivity type is an nMOS transistor. The same explanation is applicable in the case where the transistor of the first conductivity type is a PNP bipolar transistor and the transistor of the second conductivity type is an NPN bipolar transistor. In this case, a control terminal corresponds to a bipolar base.

First Embodiment

FIG. 1 is a circuit diagram illustrating an example of the circuit configuration of a constant-voltage power supply circuit 100 according to a first embodiment.

As illustrated in FIG. 1, the constant-voltage power supply circuit 100 includes a first transistor (pMOS transistor) M1 of the first conductivity type which is an output transistor, an output voltage control amplifier A1, a current-limiting characteristic control circuit A2, a constant current control circuit A3, a buffer circuit A4, a voltage divider circuit A5, a reference voltage source VA1, a power supply terminal Tin, and an output terminal Tout.

The power supply terminal Tin is connected to a power supply (not shown). A power supply voltage Vin is supplied to the power supply terminal Tin from the power supply.

A load (not shown) is connected between the output terminal Tout and ground. An output voltage Vout from the output terminal Tout is supplied to the load.

The first transistor M1 is connected between the power supply terminal Tin and the output terminal Tout. The first transistor M1 has a control terminal (gate) connected to the output of the output voltage control amplifier A1. In other words, the operations of the first transistor M1 are controlled according to the output of the output voltage control amplifier A1.

The voltage divider circuit A5 includes a first resistor (voltage dividing resistor) R1 having one end connected to the output terminal Tout and a second resistor (voltage dividing resistor) R2 having one end connected to the other end of the first resistor R1 and the other end connected to the ground. The voltage divider circuit A5 outputs a divided voltage Vm (=R2/(R1+R2)×Vout) between the first resistor R1 and the second resistor R2.

The first resistor R1 has an adjustable resistance value. For example, the resistance value of the first resistor R1 is adjusted by trimming.

For example, when the first resistor R1 has a large resistance value, a target value Vt for the output voltage Vout is set high, whereas when the first resistor R1 has a small resistance value, the target value Vt for the output voltage Vout is set low.

In the adjustment of the target value Vt, the resistance value of the second resistor R2 is fixed, so that a change of the divided voltage Vm is smaller than a change of the target value Vt when the resistance value of the first resistor R1 is adjusted.

The output voltage control amplifier A1 compares the divided voltage Vm and a preset reference voltage V1 generated by the reference voltage source VA1, and controls the voltage of the control terminal (gate) of the first transistor M1 so as to equalize the divided voltage Vm and the reference voltage V1.

For example, in the case where the divided voltage Vm is lower than the reference voltage V1, the output voltage control amplifier A1 controls the gate voltage of the first transistor M1 (to "Low" level) so as to increase a current passing through the first transistor M1 (so as to turn on the first transistor M1).

In the case where the divided voltage Vm is higher than the reference voltage V1, the output voltage control amplifier A1 controls the gate voltage of the first transistor M1 (to "High" level) so as to reduce a current passing through the first transistor M1 (so as to turn off the first transistor M1).

The buffer circuit A4 has an input connected to the other end of the first resistor R1 and an output connected to the other end (source) of a second transistor M2. The buffer circuit A4 outputs, as a control voltage V3, a voltage obtained by impedance conversion on the divided voltage Vm.

Furthermore, the current-limiting characteristic control circuit A2 controls the voltage of the control terminal (gate) of the first transistor M1 according to the divided voltage Vm and an output current Iout.

The current-limiting characteristic control A2 circuit A2 includes a first constant current source IA2, a second transistor (nMOS transistor) M2 of the second conductivity type, a third transistor (nMOS transistor) M3 of the second conductivity type, a fourth transistor (pMOS transistor) M4 of the first conductivity type, a fifth transistor (pMOS transistor) M5 of the first conductivity type, a sixth transistor (nMOS transistor) M6 of the second conductivity type, a third resistor R3, a fourth resistor R4, and a fifth resistor R5.

The first constant current source IA2 has one end connected to the power supply terminal Tin and outputs a constant current.

The second transistor M2 is diode-connected and has one end (drain) connected to the other end of the first constant current source IA2 and the other end (source) supplied with the control voltage V3 based on the divided voltage Vm.

The third transistor M3 has a control terminal (gate) connected to the control terminal (gate) of the second transistor M2. In other words, the third transistor M3 and the second transistor M2 constitute a current mirror circuit. Thus, the third transistor M3 is supplied with a current obtained by current-mirroring a current passing through the second transistor M2.

The gate lengths and gate widths of the second and third transistors M2 and M3 are set such that the gate-to-source voltage of the second transistor M2 approximates the gate-to-source voltage of the third transistor M3.

The fourth transistor M4 is connected between the power supply terminal Tin and one end (drain) of the third transistor M3 and has a control terminal (gate) connected to the control terminal (gate) of the first transistor M1.

In other words, the fourth transistor M4 and the first transistor M1 constitute a current mirror circuit. Thus, the fourth transistor M4 has the function of detecting the output current Iout.

The third resistor R3 is connected between the other end (source) of the third transistor M3 and the ground.

The fourth resistor R4 is connected between one end (drain) of the third transistor M3 and the ground.

The fifth transistor M5 has one end (source) connected to the power supply terminal Tin and the other end connected to the control terminal (gate) of the fourth transistor M4.

The fifth resistor R5 is connected between the power supply terminal Tin and the control terminal (gate) of the fifth transistor M5.

The sixth transistor M6 is connected between the control terminal (gate) of the fifth transistor M5 and the ground and has a control terminal (gate) connected to one end (drain) of the third transistor M3.

The constant current control circuit A3 limits the voltage of the control terminal (gate) of the first transistor M1 such that the output current Iout passing through the output terminal Tout does not exceed a current value Ia.

The constant current control circuit A3 includes a seventh transistor (pMOS transistor) M7 of the first conductivity type, an eighth transistor (pMOS transistor) M8 of the first conductivity type, a ninth transistor (pMOS transistor) M9 of the first conductivity type, a tenth transistor (nMOS transistor) M10 of the second conductivity type, an eleventh transistor (pMOS transistor) M11 of the first conductivity type, a twelfth transistor (nMOS transistor) M12 of the second conductivity type, a second constant current source IA3, and a sixth resistor R6.

The seventh transistor M7 is diode-connected and has one end (source) connected to the output terminal Tout.

The second constant current source IA3 is connected between the other end (drain) of the seventh transistor M7 and the ground and outputs a constant current.

The eighth transistor M8 has one end (source) connected to the power supply terminal Tin and a control terminal (gate) connected to the control terminal (gate) of the first transistor M1.

In other words, the eighth transistor M8 and the first transistor M1 constitute a current mirror circuit. Thus, the eighth transistor M8 has the function of detecting the output current Iout.

The ninth transistor M9 has one end (source) connected to the other end (drain) of the eighth transistor M8 and a control terminal (gate) connected to the control terminal (gate) of the seventh transistor M7.

The tenth transistor M10 is diode-connected and connected between the other end (drain) of the ninth transistor M9 and the ground.

The eleventh transistor M11 has one end (source) connected to the power supply terminal Tin and the other end (drain) connected to the control terminal (gate) of the first transistor and the control terminal (gate) of the eighth transistor M8.

The sixth resistor R6 is connected between the power supply terminal Tin and the control terminal (gate) of the eleventh transistor M11.

The twelfth transistor M12 is connected between the control terminal (gate) of the eleventh transistor and the ground and has a control terminal (gate) connected to the control terminal (gate) of the tenth transistor M10.

In other words, the twelfth transistor M12 and the tenth transistor M10 constitute a current mirror circuit.

Figure 2:
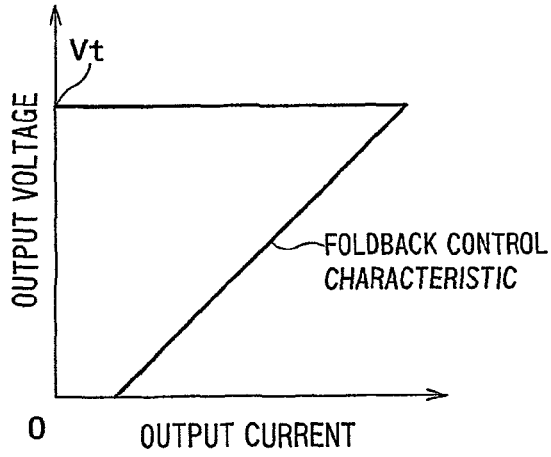
FIG. 2 is a diagram showing an example of a relationship between an output voltage and an output current under a foldback current-limiting characteristic control of the constant-voltage power supply circuit 100.
Figure 3:
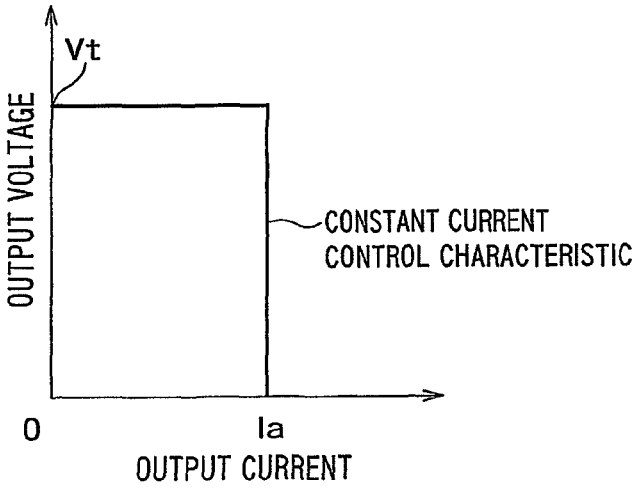
FIG. 3 is a diagram showing an example of a relationship between an output voltage and an output current under a constant current control of the constant-voltage power supply circuit 100.
Figure 4:
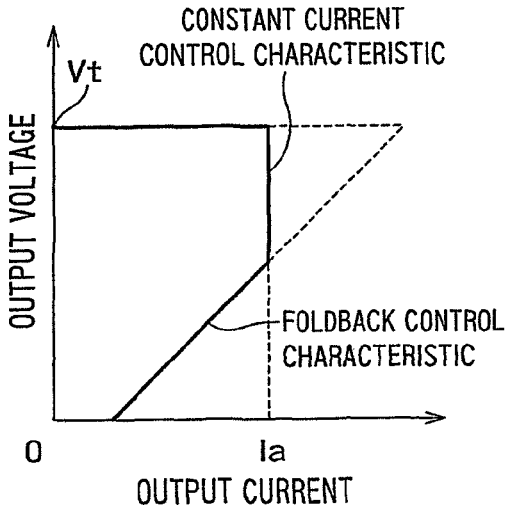
FIG. 4 is a diagram showing an example of a relationship between an output voltage and an output current under combined control of a foldback current-limiting characteristic control and constant current control of the constant-voltage power supply circuit 100.

The following will discuss the operating characteristics of the constant-voltage power supply circuit 100 configured thus. FIG. 2 shows an example of the relationship between an output voltage and an output current under the foldback current-limiting characteristic control of the constant-voltage power supply circuit 100. FIG. 3 shows an example of the relationship between an output voltage and an output current under the constant current control of the constant-voltage power supply circuit 100. FIG. 4 shows an example of the relationship between an output voltage and an output current under combined control of the foldback current-limiting characteristic control and constant current control of the constant-voltage power supply circuit 100.

An overcurrent protection operation by the current-limiting characteristic control circuit A2 will be first discussed below.

As has been discussed, a current I1 passing through the fourth transistor M4 is a current obtained by current-mirroring a current passing through the first transistor M1, which is an output transistor. Thus, the first current I1 is determined by the ratio of the gate length and the gate width of each of the first transistor M1 and the fourth transistor M4 and the output current Iout.

A current I2 passing through the third transistor M3 is expressed as I2=I1−I3.

A current I3 passing through the fourth resistor R4 is determined by the drain voltage of the third transistor M3 and the resistance value of the fourth resistor R4.

The gate voltage of the third transistor M3 is obtained by adding the control voltage V3 based on the divided voltage Vm to the gate-to-source voltage of the second transistor M2.

As described above, the current I1 is the current-mirror current of the output current Iout. Thus, as the output current Iout rises, a voltage V2 on one end of the fourth resistor R4 (that is, one end (drain) of the second MOS transistor M2) increases. When the voltage V2 rises, a current starts passing through the sixth transistor M6, a potential difference is generated on the fifth resistor R5, and the fifth transistor M5 operates.

For example, in the case where the value of the output current Iout exceeds a set value, the current I3 increases with an increase in the current I1 obtained by current-mirroring a current passing through the first transistor M1, thereby increasing a voltage drop across the fourth resistor R4. Thus, the gate voltage of the sixth transistor M6 increases and the sixth transistor M6 is turned on, thereby increasing a voltage drop across the fifth resistor R5. Hence, the gate voltage of the fifth transistor M5 decreases and the fifth transistor M5 is turned on, thereby increasing the voltage of the other end (drain) of the fifth transistor M5 and the gate voltage of the first transistor M1. This allows the first transistor M1 to operate in an off direction to limit a current (output current Iout).

In the case where a load impedance decreases with overcurrent protection, the output voltage decreases (a drain-to-source voltage VDS of the output transistor increases) because the output current Iout is limited. As the output voltage Vout falls, the current value of the current I1 and the output current Iout decrease.

As described above, in the case where the value of the output current Iout exceeds the set value, the overcurrent protection function is performed by the current-limiting characteristic control circuit A2. In other words, the current-limiting characteristic control circuit A2 can configure the overcurrent protection function shown in FIG. 2.

As has been discussed, in the present embodiment, the gate lengths and gate widths of the second and third transistors M2 and M3 are set such that the gate-to-source voltage of the second transistor. M2 approximates the gate-to-source voltage of the third transistor M3. Thus, a voltage applied to the third resistor R3 is set at a value close to the control voltage V3 (divided voltage Vm). The divided voltage Vm, which is a feedback signal of the output voltage Vout, corresponds to the value of the reference voltage V1 during a normal operation.

Therefore, when the overcurrent protection function of the current-limiting characteristic control circuit A2 or the constant current control circuit A3 is performed, the divided voltage Vm, that is, a voltage applied to the third resistor R3 decreases in proportion to the output voltage Vout.

Thus, the current I2 passing through the third transistor M3 is determined by a rate of reduction of the output voltage Vout (output voltage÷target value). In other words, the higher the target value Vt of the output voltage Vout, the higher the value of the output voltage Vout for operating the current-limiting characteristic control circuit A2.

Specifically, the first resistor R1 is increased and the target value Vt is set high. Thus, even when the output voltage Vout increases, the value of the output voltage Vout for operating the current-limiting characteristic control circuit A2 also increases, thereby suppressing an increase in voltage drop across the first transistor M1 when the target value Vt of the output voltage Vout is high.

An overcurrent protection operation by the constant current control circuit A3 will be described below.

As has been discussed, a current I4 passing through the eighth transistor M8 is obtained by current-mirroring a current passing through the first transistor M1, which is an output transistor. Thus, the current I4 is determined by the ratio of the gate length and the gate width of each of the first transistor M1 and the fourth transistor M4 and the value of the output current Iout.

Furthermore, as has been discussed, a current I5 passing through the twelfth transistor M12 is obtained by current-mirroring the current I4 passing through the tenth transistor M10.

Hence, the current I5 is proportionate to the output current Iout.

The gate voltage of the eleventh transistor M11 is determined by the resistance value of the sixth resistor R6 and the value of the current I5. The eleventh transistor M11 operates so as to control the gate voltage of the first transistor M1, which is an output transistor.

For example, in the case where the value of the output current Iout exceeds the set value, the current I5 increases with an increase in the current I4 obtained by current-mirroring a current passing through the first transistor M1, thereby increasing a voltage drop across the sixth resistor R6. Thus, the gate voltage of the eleventh transistor M11 decreases and the eleventh transistor M11 is turned on, thereby increasing the voltage of the other end (drain) of the eleventh transistor M11 and the gate voltage of the first transistor M1. This allows the first transistor M1 to operate in the off direction to limit a current (output current Iout).

As described above, in the case where the value of the output current Iout exceeds the current value Ia, the overcurrent protection function is performed by the constant current control circuit A3. In other words, the current-limiting characteristic control circuit A3 can configure the overcurrent protection function shown in FIG. 3.

Since the current-limiting characteristic control circuit A2 and the constant current control circuit A3 operate in parallel, the overcurrent protection function of the constant-voltage power supply circuit 100 exhibits characteristics shown in FIG. 4.

Figure 5:
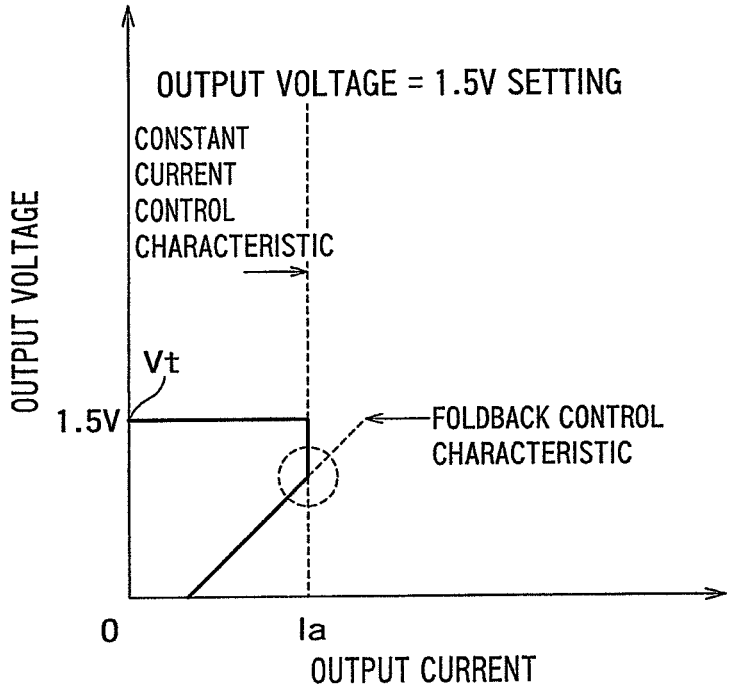
FIG. 5 is a diagram showing a relationship between an output voltage and an output current of the constant-voltage power supply circuit 100 in a case where a target value of an output voltage is low (1.5 V)
Figure 6:
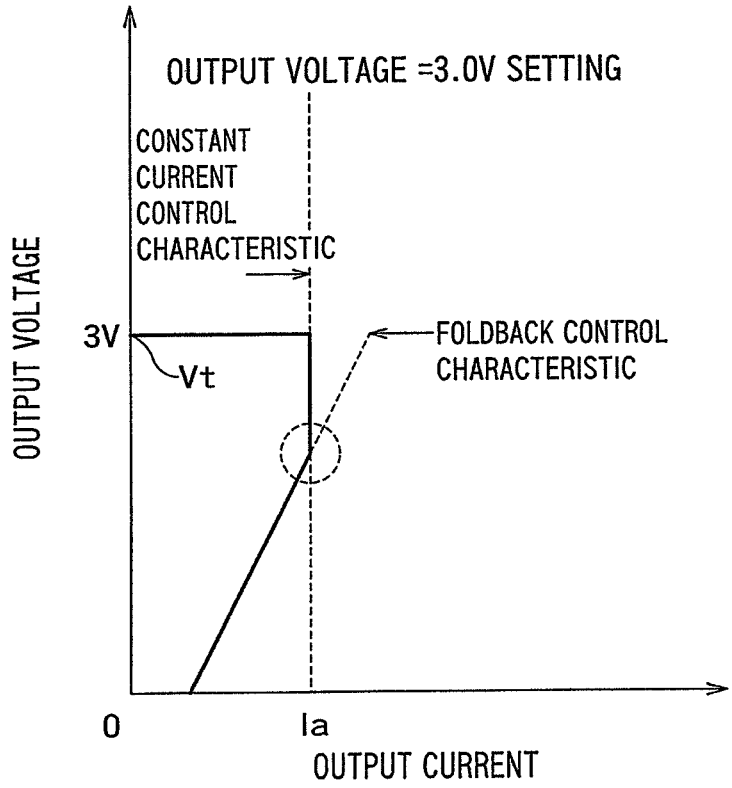
FIG. 6 is a diagram showing a relationship between an output voltage and an output current of the constant-voltage power supply circuit 100 in a case where the target value of the output voltage is high (3.0 V).

FIG. 5 shows the relationship between an output voltage and an output current of the constant-voltage power supply circuit 100 in the case where the target value of the output voltage is low (1.5 V). FIG. 6 shows the relationship between an output voltage and an output current of the constant-voltage power supply circuit 100 in the case where the target value of the output voltage is high (3.0 V). FIGS. 5 and 6 show an output current waveform (dotted line) of constant current control, an output current waveform (dotted line) of foldback current-limiting characteristic control, and an actual output current waveform (solid line).

As shown in FIGS. 5 and 6, the characteristics of the overcurrent protection function of the constant-voltage power supply circuit 100 vary with a change of the target value Vt.

Specifically, in the case where the target value Vt of the output voltage Vout is low (1.5 V), the current-limiting characteristic control circuit A2 has a low operating voltage. However, the power loss of the output transistor is low because of the low target value Vt of the output voltage Vout.

In the case where the target value Vt of the output voltage Vout is high (3.0 V), the operating voltage of the current-limiting characteristic control circuit A2 increases so as to limit a current at an earlier stage (at a higher voltage value). Hence, the power loss of the output transistor, a problem in the related art, can be limited.

As described above, the constant-voltage power supply circuit according to the first embodiment can reduce the power loss of the output transistor.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A constant-voltage power supply circuit comprising:
- a first transistor of a first conductivity type, connected between a power supply terminal and an output terminal;
- a voltage divider circuit including a first resistor having a first end connected to the output terminal and a second resistor having a first end connected to a second end of the first resistor and a second end connected to ground, the voltage divider circuit outputting a divided voltage between the first resistor and the second resistor;
- an output voltage control amplifier comparing the divided voltage and a reference voltage and controlling a voltage of a control terminal of the first transistor so as to equalize the divided voltage and the reference voltage; and
- a current-limiting characteristic control circuit controlling the voltage of the control terminal of the first transistor according to the divided voltage and an output current, the current-limiting characteristic control circuit comprising:
- a first constant current source having a first end connected to the power supply terminal and outputting a constant current;
- a second transistor of a second conductivity type, the second transistor being diode-connected, having a first end connected to a second end of the first constant current source, and having a second end supplied with a control voltage based on the divided voltage;
- a third transistor of the second conductivity type, having a control terminal connected to a control terminal of the second transistor;
- a fourth transistor of the first conductivity type, connected between the power supply terminal and a first end of the third transistor and having a control terminal connected to the control terminal of the first transistor;
- a third resistor connected between a second end of the third transistor and the ground;
- a fourth resistor connected between the first end of the third transistor and the ground;
- a fifth transistor of the first conductivity type, having a first end connected to the power supply terminal and a second end connected to the control terminal of the first transistor and the control terminal of the fourth transistor;
- a fifth resistor connected between the power supply terminal and a control terminal of the fifth transistor; and
- a sixth transistor of the second conductivity type, connected between the control terminal of the fifth transistor and the ground and having a control terminal connected to the first end of the third transistor.

2. The constant-voltage power supply circuit according to claim 1, further comprising a buffer circuit that outputs, as the control voltage, a voltage obtained by impedance conversion on the divided voltage.

3. The constant-voltage power supply circuit according to claim 2, wherein the buffer circuit has an input connected to the second end of the first resistor and an output connected to the second end of the second transistor.

4. The constant-voltage power supply circuit according to claim 1, further comprising a constant current control circuit limiting the voltage of the control terminal of the first transistor such that the output current passing through the output terminal does not exceed a current value.

5. The constant-voltage power supply circuit according to claim 4, wherein the constant current control circuit comprises:
- a seventh transistor of the first conductivity type, being diode-connected and having a first end connected to the output terminal;

a second constant current source connected between a second end of the seventh transistor and the ground and outputting the constant current;

an eighth transistor of the first conductivity type, having a first end connected to the power supply terminal and a control terminal connected to the control terminal of the first transistor;

a ninth transistor of the first conductivity type, having a first end connected to a second end of the eighth transistor and a control terminal connected to a control terminal of the seventh transistor;

a tenth transistor of the second conductivity type, being diode-connected and connected between a second end of the ninth transistor and the ground;

an eleventh transistor of the first conductivity type, having a first end connected to the power supply terminal and a second end connected to the control terminal of the first transistor and the control terminal of the eighth transistor;

a sixth resistor connected between the power supply terminal and a control terminal of the eleventh transistor; and a twelfth transistor of the second conductivity type, being connected between the control terminal of the eleventh transistor and the ground and having a control terminal connected to a control terminal of the tenth transistor.

6. The constant-voltage power supply circuit according to claim 1, wherein the first resistor has an adjustable resistance value.

7. The constant-voltage power supply circuit according to claim 6, wherein a resistance value of the first resistor is adjusted by trimming.

8. The constant-voltage power supply circuit according to claim 1, wherein the first, fourth, and fifth transistors are pMOS transistors, and the second, third, and sixth transistors are nMOS transistors.

9. The constant-voltage power supply circuit according to claim 8, wherein a gate length and a gate width of the second transistor and a gate length and a gate width of the third transistor are set such that a gate-to-source voltage of the second transistor approximates a gate-to-source voltage of the third transistor.

10. The constant-voltage power supply circuit according to claim 5, wherein the seventh, eighth, ninth and eleventh transistors are pMOS transistors, and the tenth and twelfth transistors are nMOS transistors.

11. A constant-voltage power supply circuit comprising:

a first transistor of a first conductivity type, connected between a power supply terminal and an output terminal;

a voltage divider circuit including a first resistor having a first end connected to the output terminal and a second resistor having a first end connected to a second end of the first resistor and a second end connected to ground, the voltage divider circuit outputting a divided voltage between the first resistor and the second resistor;

an output voltage control amplifier comparing the divided voltage and a reference voltage and controlling a voltage of a control terminal of the first transistor so as to equalize the divided voltage and the reference voltage; and a current-limiting characteristic control circuit controlling the voltage of the control terminal of the first transistor according to the divided voltage and an output current, the current-limiting characteristic control circuit comprising:

a second transistor of a second conductivity type, being diode-connected, having a first end connected to the power supply terminal via a first constant current source, and having a second end supplied with a control voltage based on the divided voltage;

a third transistor of the second conductivity type, having a first end connected to the power supply terminal via a fourth transistor of the first conductivity type and having a control terminal connected to a control terminal of the second transistor, wherein the first end of the third transistor is connected to a current passing through the fourth transistor and obtained by current-mirroring a current passing through the first transistor, and a current passing through the third transistor which is obtained by current-mirroring a current passing through the second transistor;

a third resistor connected between a second end of the third transistor and the ground;

a fourth resistor connected between the first end of the third transistor and the ground;

wherein the voltage of the control terminal of the first transistor is controlled based on a voltage of the first end of the second transistor and the output current.

12. The constant-voltage power supply circuit according to claim 11, further comprising a buffer circuit that outputs, as the control voltage, a voltage obtained by impedance conversion on the divided voltage.

13. The constant-voltage power supply circuit according to claim 12, wherein the buffer circuit has an input connected to the second end of the first resistor and an output connected to the second end of the second transistor.

14. The constant-voltage power supply circuit according to claim 11, further comprising a constant current control circuit limiting the voltage of the control terminal of the first transistor such that the output current passing through the output terminal does not exceed a current value.

15. The constant-voltage power supply circuit according to claim 14, wherein the constant current control circuit comprises:

a seventh transistor of the first conductivity type, being diode-connected and having a first end connected to the output terminal;

a second constant current source connected between a second end of the seventh transistor and the ground and outputting a constant current;

an eighth transistor of the first conductivity type, having a first end connected to the power supply terminal and a control terminal connected to the control terminal of the first transistor;

a ninth transistor of the first conductivity type, having a first end connected to a second end of the eighth transistor and a control terminal connected to a control terminal of the seventh transistor;

a tenth transistor of the second conductivity type, being diode-connected and connected between a second end of the ninth transistor and the ground;

an eleventh transistor of the first conductivity type, having a first end connected to the power supply terminal and a second end connected to the control terminal of the first transistor and the control terminal of the eighth transistor;

a sixth resistor connected between the power supply terminal and a control terminal of the eleventh transistor; and a twelfth transistor of the second conductivity type, being connected between the control terminal of the eleventh transistor and the ground and having a control terminal connected to a control terminal of the tenth transistor.

16. The constant-voltage power supply circuit according to claim 11, wherein the first resistor has an adjustable resistance value.

17. The constant-voltage power supply circuit according to claim 16, wherein a resistance value of the first resistor is adjusted by trimming.

18. The constant-voltage power supply circuit according to claim 11, wherein the first and fourth transistors are pMOS transistors, and the second and third transistors are nMOS transistors.

19. The constant-voltage power supply circuit according to claim 18, wherein a gate length and a gate width of the second transistor and a gate length and a gate width of the third transistor are set such that a gate-to-source voltage of the second transistor approximates a gate-to-source voltage of the third transistor.

20. The constant-voltage power supply circuit according to claim 15, wherein the seventh, eighth, ninth and eleventh transistors are pMOS transistors, and the tenth and twelfth transistors are nMOS transistors.

* * * * *